US006209375B1

(12) United States Patent
Kurose

(10) Patent No.: US 6,209,375 B1
(45) Date of Patent: Apr. 3, 2001

(54) PANEL ASSEMBLY AND PANEL FORMING APPARATUS

(75) Inventor: Kazutoshi Kurose, Kanagawa (JP)

(73) Assignee: Gomeigaisha Kurose & Co., Hiroshima (JP)

( * ) Notice: Subject to any disclaimer, the term of this patent is extended or adjusted under 35 U.S.C. 154(b) by 0 days.

(21) Appl. No.: 09/494,870

(22) Filed: Jan. 31, 2000

Related U.S. Application Data

(62) Division of application No. 09/162,557, filed on Sep. 29, 1998.

(30) Foreign Application Priority Data

Oct. 7, 1997 (JP) ..... 9-289212

(51) Int. Cl.[7] ..... B21D 5/08; B21D 13/04
(52) U.S. Cl. ..... 72/181; 72/379.6
(58) Field of Search ..... 72/180, 181, 379.6, 72/385

(56) References Cited

U.S. PATENT DOCUMENTS

| | | | | |
|---|---|---|---|---|
| 3,160,132 | * | 12/1964 | Mowatt | 72/379.6 |
| 3,251,211 | | 5/1966 | Harris . | |
| 3,474,513 | * | 10/1969 | Allingham | 72/379.6 |
| 3,931,725 | * | 1/1976 | Yon | 72/181 |
| 4,945,624 | | 8/1990 | Toti . | |
| 5,056,348 | * | 10/1991 | Albrecht | 72/181 |

FOREIGN PATENT DOCUMENTS

| | | | | |
|---|---|---|---|---|
| 168499 | * | 6/1934 | (CH) | 72/379.6 |
| 628409 | | 2/1982 | (CN) . | |
| 1223928 | | 6/1960 | (FR) . | |
| 253272 | * | 7/1926 | (GB) | 72/379.6 |
| 910110 | | 11/1962 | (GB) . | |
| 23774 | * | 7/1972 | (JP) | 72/180 |
| 257931 | * | 12/1985 | (JP) | 72/385 |
| 43290 | * | 6/1938 | (NL) | 72/385 |
| 70653 | | 3/1952 | (NL) . | |
| 1174120 | * | 8/1985 | (SU) | 72/181 |
| 1755995 | * | 8/1992 | (SU) | 72/181 |

OTHER PUBLICATIONS

Evans, Brian, Advanced techniques and machines for cold roll forming—Part 1, *Sheet Metal Industries,* Jul. 1973, pp. 389–396.

Evans, Brian, Advanced techniques and machines for cold roll forming—*Part 2, Sheet Metal Industries,* Aug., 1973, pp. 448–455.

* cited by examiner

*Primary Examiner*—Daniel C. Crane
(74) *Attorney, Agent, or Firm*—Nilles & Nilles SC

(57) ABSTRACT

The sheet panel of the present invention is formed by a panel forming apparatus comprising a first forming mechanism for forming a center projection at a central portion of a sheet panel, a second forming mechanism for forming S-shaped curve faces on both sides of the center projection of the sheet panel, a third forming mechanism for forming side projections at both sides of the center projection of the sheet panel, and a fourth forming mechanism for forming S-shaped curve faces on both sides of the side projections of the sheet panel.

4 Claims, 8 Drawing Sheets

PANEL ASSEMBLY AND PANEL FORMING APPARATUS

This application is a division, of application Ser. No. 09/162,557, filed Sep. 29, 1998.

BACKGROUND OF THE INVENTION

1. Field of the Invention

The present invention relates to a panel assembly and a panel forming apparatus, and more particularly, relates to a panel assembly having a stringer and a sheet panel clampingly secured to projections and recesses provided on the stringer and an apparatus for forming said sheet panel.

2. Description of the Prior Art

A panel assembly is disclosed in the Japanese Patent Publication Nos. 42-26591, 46-14394 and 44-11699, for example.

The conventional panel assembly comprises a stringer 1 and a plurality of panel elements 2, as shown in FIG. 1.

The stringer 1 is formed of a plate-of aluminum alloy, for example, by press working in a predetermined figure shown in FIG. 1 and bent so as to have a U-shaped cross-section as shown in FIG. 2. The stringer 1 can be formed by molding a plastic material instead of the aluminum alloy. The stringer 1 has projections 5*a* each having convex portions 3 at both sides thereof and recesses 5*b* each having concave portions 4 at both sides thereof. Each of said projections 5*a* and each of said recesses 5*b* are arranged alternately with a constant interval on the top of each of side walls of the stringer 1.

Each of said panel elements 2 is formed of a baking finished plate of aluminum alloy or plastic and has convex portions 6 at both sides thereof.

A first panel element 2 facing upward is clampingly secured to the recess 5*b* formed between the projections 5*a* of the stringer 1 and a second panel element 2 facing downward is put on the projection 5*a* of the stringer 1, so that the two curved edges 6 of the second panel element 2 are hooked around the two curved edges 6 of the first and third panel elements 2 clamped in the recess 5*b* to form a panel assembly.

The conventional panel assembly can be fabricated in the following manner.

One of the two curved edges 6 of the second panel element 2 to be clamped on the first projection 5*a* is hooked, as shown in FIG. 1, around one of the two bent edges.6 of the first panel element 2 clamped in the first recess 5*b* adjacent to said first projection 5*a*. Thereupon the other of the two curved edges 6 of the second panel element 2 is hooked around one of the two curved edges 6 of the third panel element 2 which has to be clamped in the second recess 5*b* adjacent to said first projection 5*a* before the third panel element 2 is placed in the second recess 5*b*. The other curved edge of the third panel element 2 is then brought into engagement with the second recess 5*b*. There after, the second and third panel elements 2 are pressed into place.

As stated above, in the conventional panel assembly, it is necessary to arrange the panel elements 2 facing upward and facing downward alternately and to engage with the projections and recesses of the stringer 1, respectively, and accordingly the work becomes hard and the panel assembly becomes expensive. Further, the conventional panel element is limited in width, so that it is difficult to form a panel assembly of large area. If the number of panel elements of the panel assembly is increased, some of the panel elements are not mounted precisely on the stringer, so that there is a danger of leaking of rain in case that the panel assembly is used as a roof, for example.

As a result of the studies and experiments it was found that a sheet panel of aluminum alloy or plastic consisting of a plurality of panel elements 2 could be obtained by a press working and that each of the panel elements 2 could be clamped on each of the projections and recesses of the stringer, respectively, by the resiliency of the sheet panel.

SUMMARY OF THE INVENTION

An object of the present invention is to obtain a panel assembly comprising a stringer provided with projections and recesses arranged alternately, each of said projections having convex portions at both sides thereof and each of said recesses having concave portions at both sides thereof, and a sheet panel having first panel portions facing downward and second panel portions facing upward arranged alternately, each of said first panel portions having convex portions at both sides thereof and each of said second panel portions adjacent to each of said first panel portions having concave portions at both sides thereof, each of said first and second panel portions corresponding in position and configuration to said projection and recess of the stringer, respectively, so that the sheet panel can be clampingly secured to the stringer.

Another object of the present invention is to obtain the panel assembly further comprising an auxiliary stringer having projections and recesses each corresponding In position and configuration to said recesses and projections of the stringer, respectively, said auxiliary stringer being fitted to the stringer through said sheet panel clamped to the stringer.

Another object of the present invention is to obtain the panel assembly further comprising a panel element having convex portions at both sides thereof to be clamped on one of the first and second panel portions of said sheet panel.

A further object of the present invention is to provide a sheet panel comprising first panel portions facing downward and second panel portions facing upward arranged alternately, each of said first panel portions having convex portions at both sides thereof and each of said second panel portions adjacent to each of said first panel portions having concave portions at both sides thereof.

A further object of the present invention is provide a panel forming apparatus comprising a first forming means for forming a center projection at a central portion of a sheet panel, a second forming means for forming S-shaped curve faces on both sides of said center projection of said sheet panel, a third forming means for forming side projections at both sides of said center projection of the sheet panel, and a fourth forming means for forming S-shaped curve faces on both sides of each of the side projections of the sheet panel, said first to fourth forming means are arranged in order in a forward direction of the sheet panel.

Each of said first and third forming means comprises a horizontal negative form roller and a horizontal positive form roller arranged above and below so as to face to each other, and each of said second and fourth forming means comprises two gourd-shaped vertical inside rollers facing the inside side faces of each of said projections, respectively, and two gourd-shaped vertical outside rollers facing the outside side faces of each of said projections, respectively.

Each of said first and third forming means consists of a plurality of forming elements arranged in order in the forward direction of said sheet panel, the figures of the negative and positive form rollers of said forming element at the upstream side of said forward direction of the sheet panel are so determined that a shallower projection can be formed, and the figures of the negative and positive form rollers of the forming element at the downstream side of said forward direction are so determined that a deeper projection can be formed.

Each of said second and fourth forming means consists of a plurality of forming elements arranged in order in the forward direction of said sheet panel, a gap formed between corresponding gourd-shaped vertical inside and outside rollers at the upstream side of said forward direction of the sheet panel being larger and a gap formed between corresponding gourd-shaped vertical inside and outside rollers at the downstream side of the forward direction of the sheet panel being smaller.

The foregoing and other objects and features of the present invention will be further described with reference to the accompanying drawings by way of example according to the present invention. The detailed description and drawings are merely illustrative rather than limiting, the scope of the invention being defined by the appended claims and equivalents thereof.

DESCRIPTION OF THE PREFERRED EMBODIMENTS

Embodiments of the present invention will now be explained with reference to the drawings attached hereto.

Figure 1:
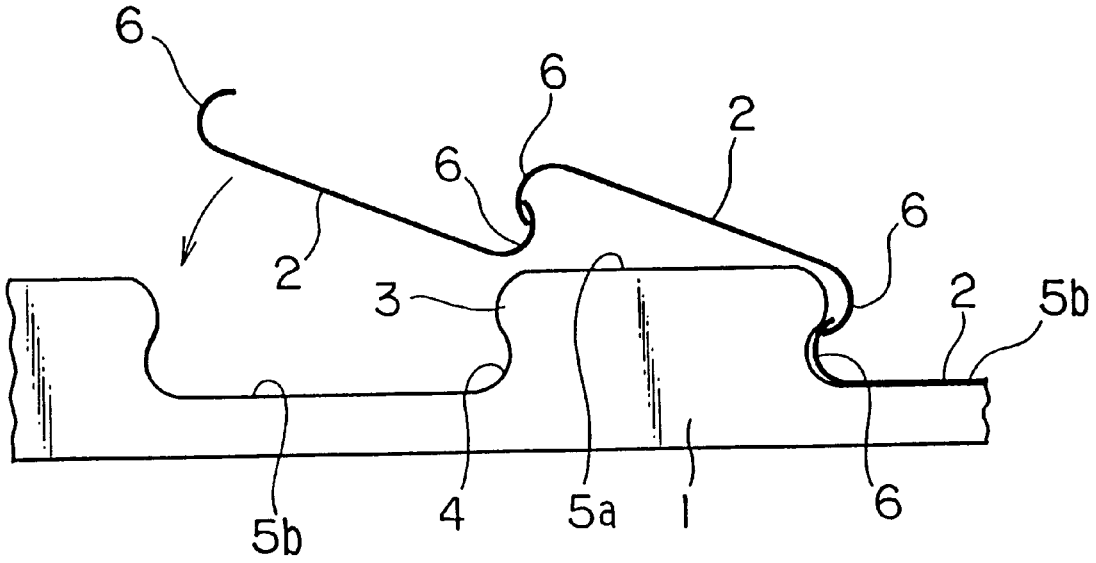
FIG.1 PRIOR ART
FIG. 1 shows a front view of a conventional panel assembly.
Figure 2:
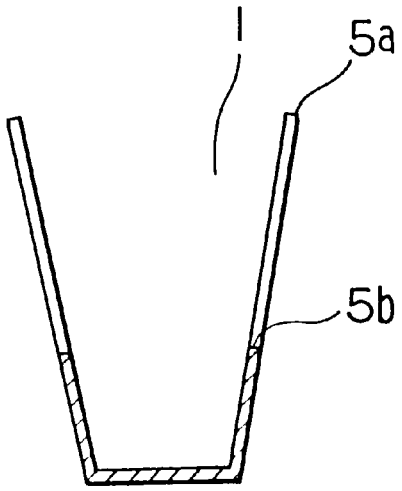
FIG.2 PRIOR ART
FIG. 2 shows a vertical sectional side view of a stringer of the panel assembly shown in FIG. 1.
Figure 3:
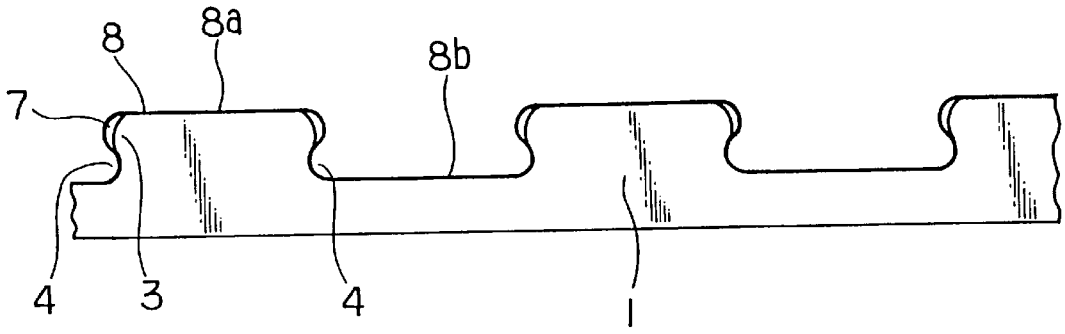
FIG. 3 shows a front view of a panel assembly of the present invention.
Figure 4:
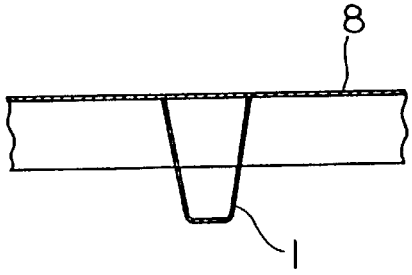
FIG. 4 shows a vertical sectional side view of the panel assembly of the present invention shown in FIG. 3.

In an embodiment of the present invention, as shown in FIGS. 3 and 4, a sheet panel 8 has first panel project portions 8*a* facing downward and second panel recess portions 8*b* facing upward arranged alternately, each of said first panel project portions 8*a* having convex portions at both sides thereof and each of said second panel recess portions 8*b* adjacent to each of said first panel project portions having concave portions at both sides thereof, each of said first and second panel portions corresponding in position and configuration to said projection 5*a* and recess 5*b* of the stringer 1, respectively, so that the sheet panel 8 can be clampingly secured to the stringer 1.

Specifically, the convex portions of the first panel portion 8*a* of the sheet panel 8 are fitted to the convex portions 3 of the projection 5*a* of the stringer 1 with a gap 7 therebetween, and the concave portions of the second panel portion 8*b* of the sheet panel 8 are fitted to the concave portions 4 of the recess 5*b* of the stringer 1.

Said sheet panel 8 can be manufactured as follows, for example.

At first, each of said first panel portions 8*a* is formed on a first portion of a plate of aluminum alloy by using a first negative form mold having a configuration similar to that of the first panel portion 8*a* and a first positive form mold having a configuration corresponding to that of said first negative form mold.

Then, each of said second panel portions 8*b* is formed on a second portion adjacent to said first portion of the plate by using a second negative form mold having a configuration similar to that of the second panel portion 8*b* and a second positive form mold having a configuration corresponding to that of said second negative form mold. The above steps are repeated.

According to the present invention, a panel assembly can easily be obtained by fitting said first and second panel portions 8*a* and 8*b* of the sheet panel 8 to the projections 5*a* and recesses 5*b* of the stringer 1, respectively.

According to the present invention, the coupling force of the sheet panel 8 to the stringer 1 is increased, because the first and second panel portions 8*a* and 8*b* of the sheet panel 8 are connected as a unit and clampingly secured to the projection 5*a* and recess 5*b* of the stringer 1, respectively.

The above fitting of the sheet panel 8 can be realized by the resiliency of the sheet panel 8 of aluminum alloy.

Figure 5:
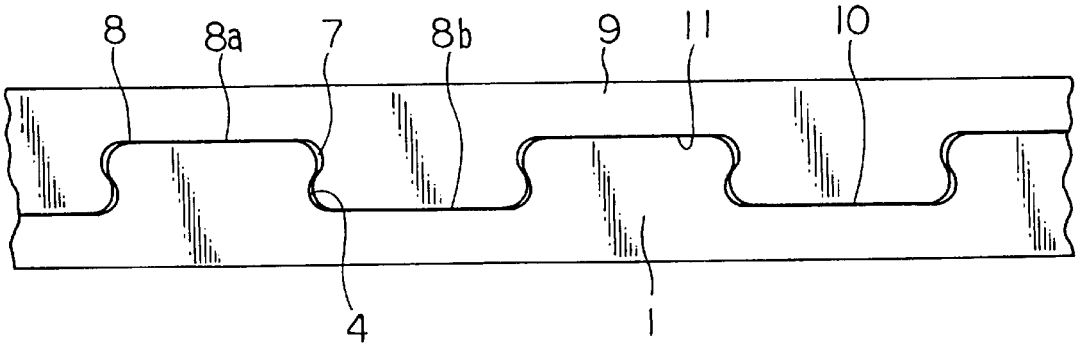
FIG. 5 shows a front view of a panel assembly of another embodiment according to the present invention.
Figure 6:
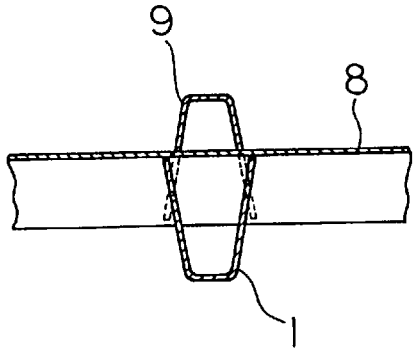
FIG. 6 shows a vertical sectional side view of the panel assembly shown in FIG. 5.

In another embodiment of the present invention, as shown in FIGS. 5 and 6, an auxiliary stringer 9 having projections 10 and recesses 11 corresponding in position and configuration to the recesses 5*b* and projections 5*a* of the stringer 1, respectively, is fitted to the stringer 1 through the sheet panel 8 so as to hold the sheet panel 8 with the stringer 1. In this embodiment, convex portions at both sides of the projection 10 of the auxiliary stringer 9 are fitted into the concave portions of the second panel portion 8*b* of the sheet panel 8 while deforming the convex portions of the first panel portion 8*a* of the panel 8 in the gap 7. The deformed portions of the panel 8 is then revived.

According to this embodiment, said panel 8 is held between the stringer 1 and the auxiliary stringer 9 firmly, so that the panel 8 is prevented from being detached arbitrarily from the stringer 1.

Figure 7:
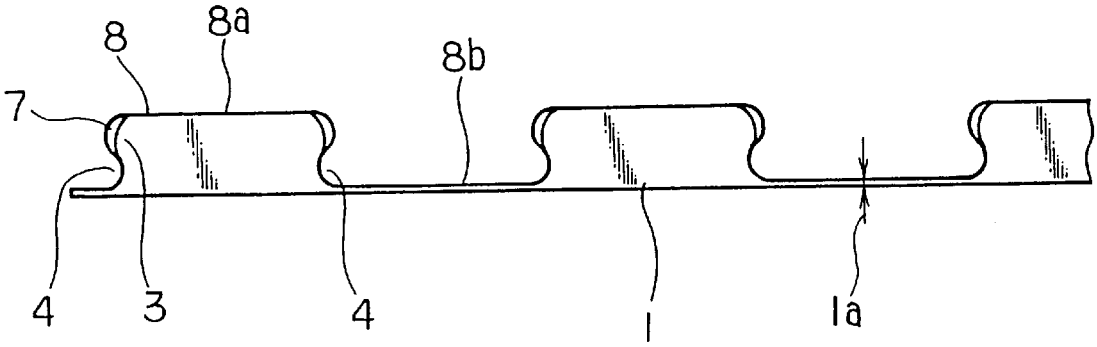
FIG. 7 shows a front view of a panel assembly of a further embodiment according to the present invention.
Figure 8:
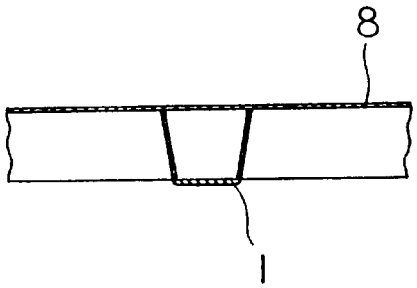
FIG. 8 shows a vertical sectional side view of the panel assembly shown in FIG. 7.

In a further embodiment of the present invention, as shown in FIGS. 7 and 8, the height 1*a* at the recess 5*b* of the stringer 1 is reduced to several millimeters similar substantially to the thickness of the panel 8.

According to this embodiment, the stringer 1 with the panel 8 can be bent at the reduced height portion of the stringer 1.

In the present invention, the panel 8 can be formed of a plastic plate instead of the aluminum alloy plate.

According to the panel assembly of the present invention, a wide panel can be used, so that a panel assembly of a large area can be fabricated easily.

Figure 16:
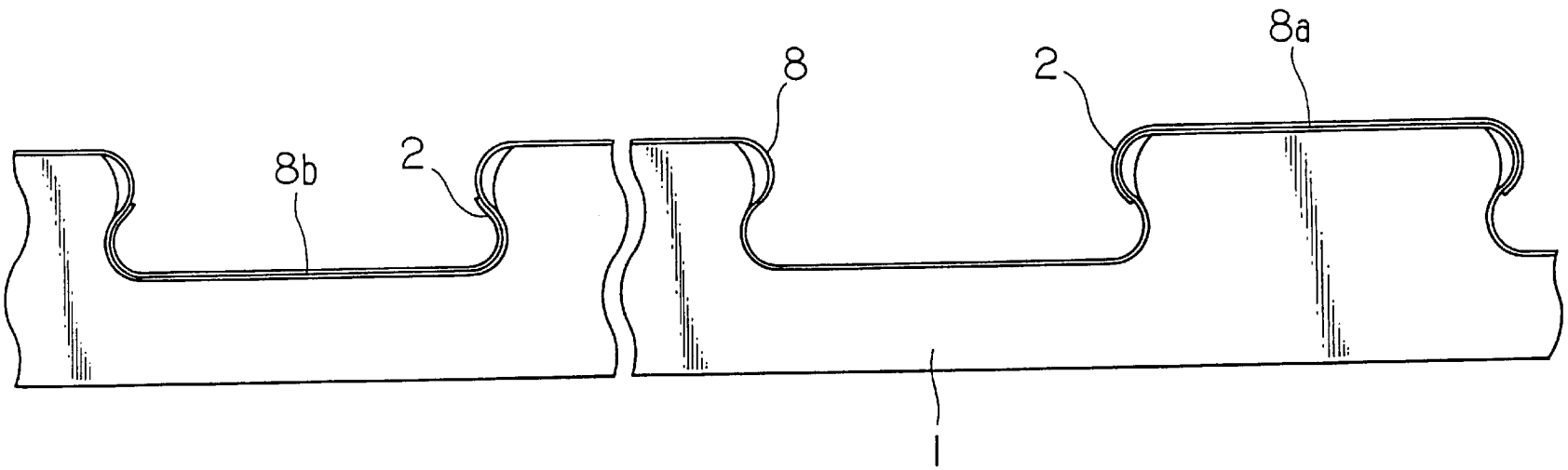
FIG. 16 is an enlarged front view of another embodiment of the present invention.

In a further embodiment of the present invention, the conventional panel element 2 having convex portions 6 at both sides thereof is fitted into the first panel portion 8*a* and/or the second panel portion 8*b* of the sheet panel 8 which has been fitted into the stringer 1 in order enhance the coupling force of the sheet panel 8 to the stringer 1, as shown in FIG. 16.

Figure 9:
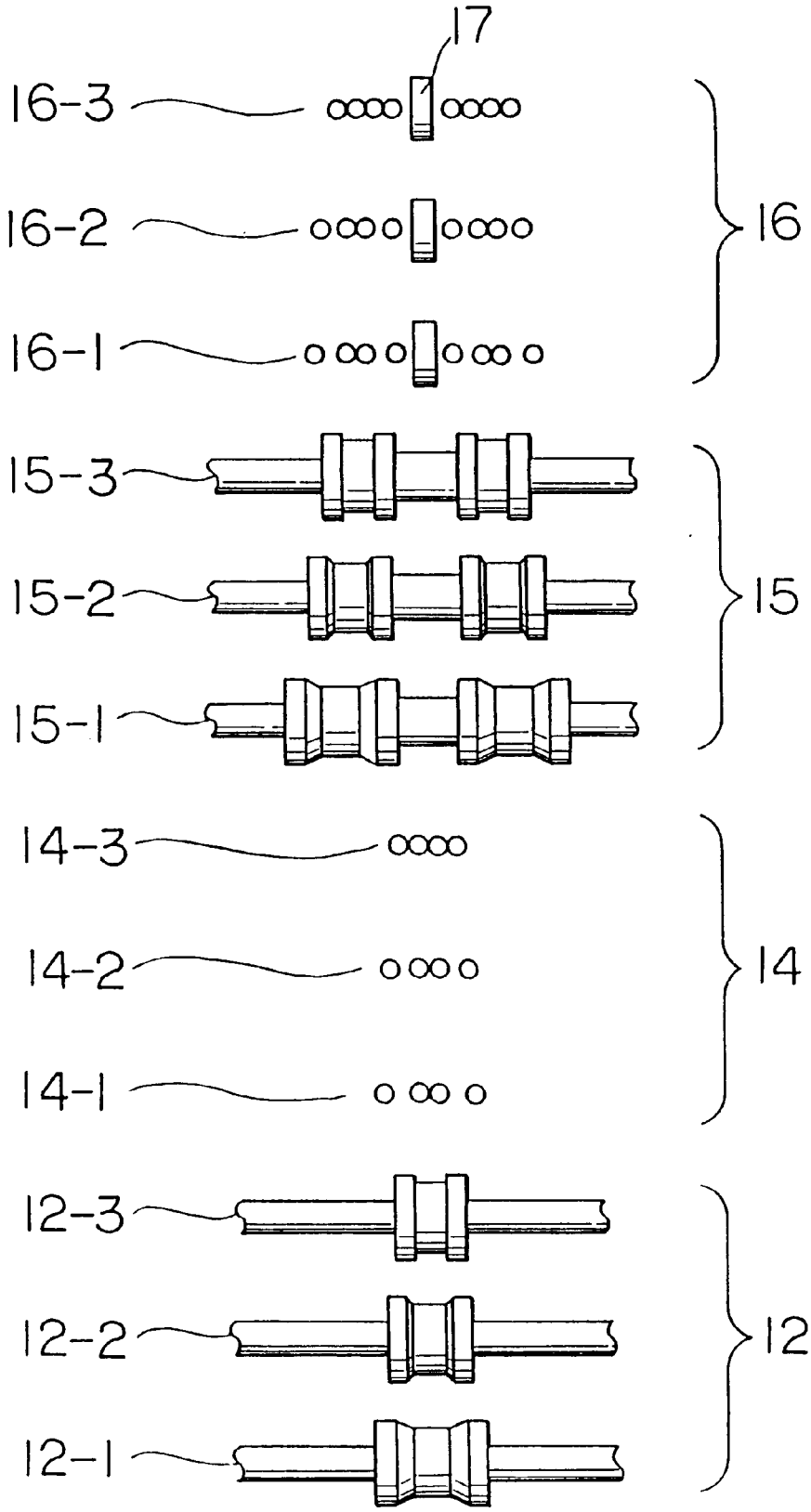
FIG. 9 shows a schematic plan view of a panel forming apparatus according to the present invention.

In a panel forming apparatus according to the present invention, as shown in FIG. 9, a first forming means 12 for forming a center projection at a central portion of the sheet panel 8, a second forming means 14 for forming S-shaped curve faces 13 on both sides of said center projection of said sheet panel 8, a third forming means 15 for forming side projections at both sides of said center projection of the sheet panel 8, and a fourth forming means 16 for forming S-shaped curve faces 13 on both sides of each of the side projections of the sheet panel 8 are arranged in order in the forward direction of the sheet panel 8. A feed roller means 17 is provided at the center portion of said fourth forming means 16.

Said first forming means 12 consists of first to third forming elements 12-1 to 12-3 arranged in order in the forward direction of the sheet panel 8, as shown in FIG. 9. Each of said first to third forming elements 12-1 to 12-3 comprises a horizontal negative form roller 18*a* and a horizontal positive form roller 18*b* arranged above and below so as to face to each other.

Figure 10:
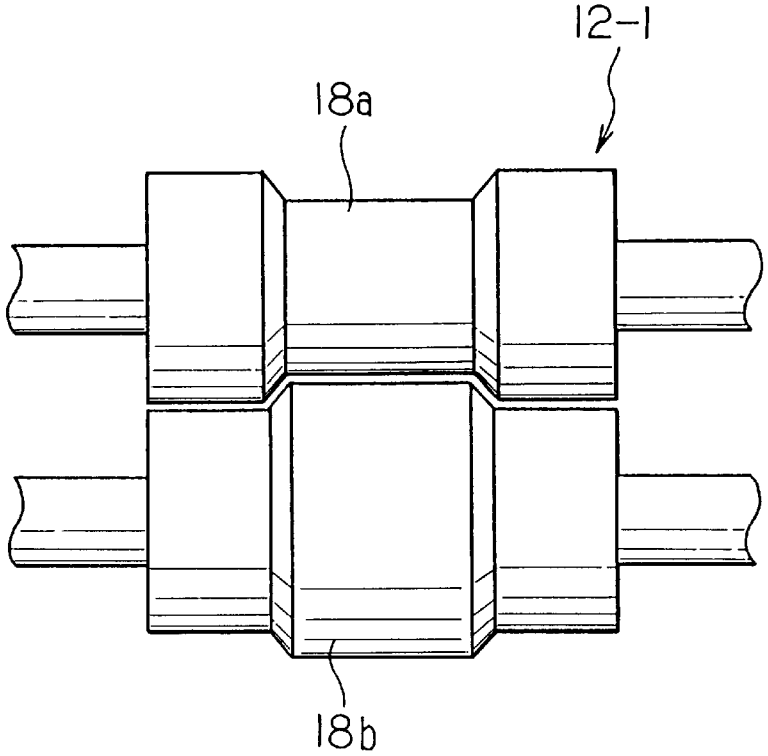
FIG. 10 is a front view of a first forming element in a first forming means of the panel forming apparatus according to the present invention.
Figure 11:
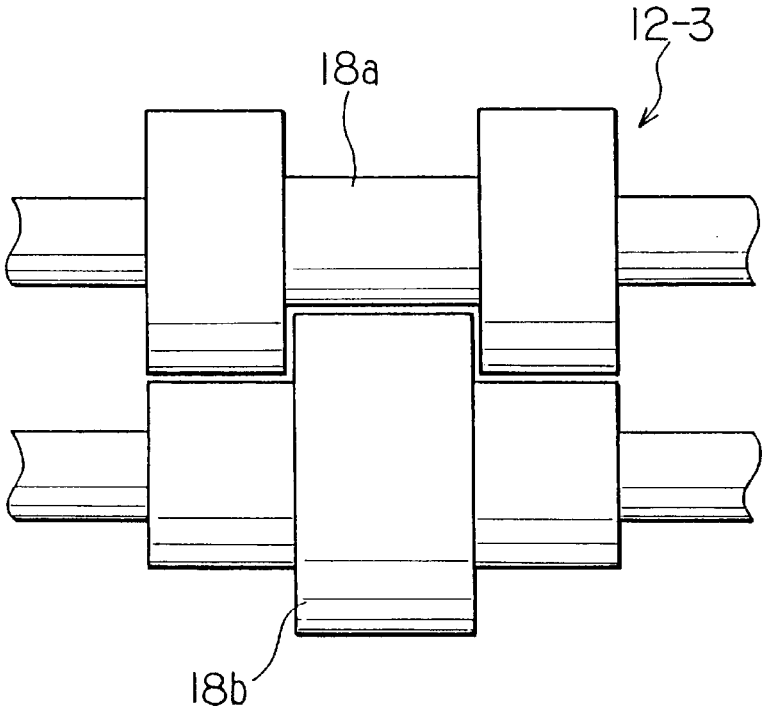
FIG. 11 is a front view of a third forming element in the first forming means of the panel forming apparatus according to the present invention.

The figures of the negative and positive form rollers 18*a* and 18*b* of said first forming element 12-1 at the upstream side of said forward direction of the sheet panel 8 are so determined that a shallower projection can be formed on the sheet panel 8, as shown in FIG. 10, and the figures of the negative and positive form rollers 18*a* and 18*b* of the third forming element 12-3 at the downstream side of said forward direction of the sheet panel 8 are so determined that a deeper projection can be formed on the sheet panel 8, as shown in FIG. 11.

The figures of the negative and positive form rollers 18*a* and 18*b* of said second forming element 12-2 at the intermediate position between said first and third forming elements 12-1 and 12-3 are so determined that a projection of an intermediate height can be formed on the sheet panel 8.

Figure 12:
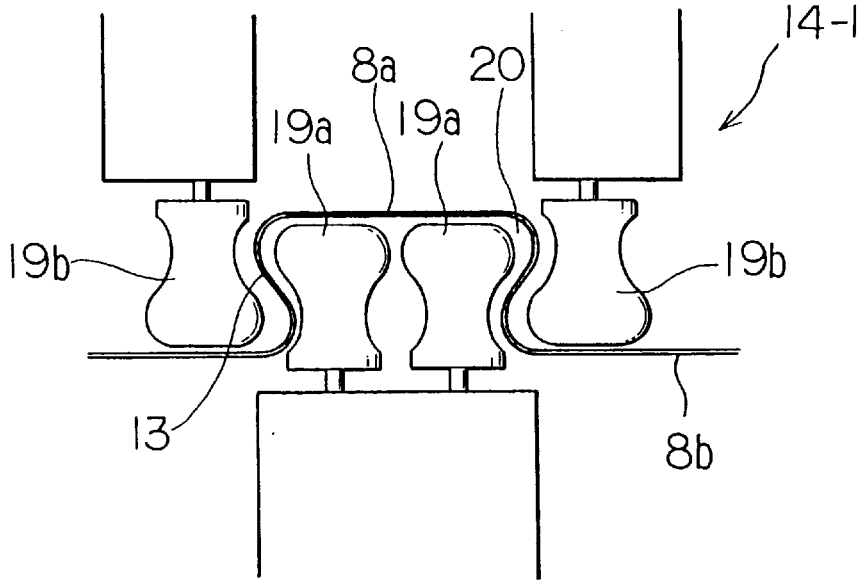
FIG. 12 is a front view of a first forming element in a second forming means of the panel forming apparatus according to the present invention.

Said second forming means 14 consists of first to third forming elements 14-1 to 14-3 arranged in order in the forward direction of said sheet panel 8, as shown in FIG. 9. Each of said second forming elements 14-1 to 14-3 comprises two gourd-shaped vertical inside rollers 19*a* and 19*a* facing the inside side faces of each of said projections of the sheet panel 8, respectively, and two gourd-shaped vertical outside rollers 19*b* and 19*a* facing the outside side faces of each of said projections, respectively, as shown in FIG. 12.

A gap 20 formed between corresponding gourd-shaped vertical inside and outside rollers 19*a* and 19*b* at the upstream side of said forward direction of the sheet panel 8 is larger, and a gap 20 formed between corresponding gourd-shaped vertical inside and outside rollers 19*a* and 19*b* at the downstream side of the forward direction of the sheet panel 8 is smaller.

Said third forming means 15 consists of first to third forming elements 15-1 to 15-3 arranged in order in the forward direction of the sheet panel 8.

Each of said first to third forming elements 15-1 to 15-3 comprises two formers arranged at both sides of the center thereof so as to be separated to each other by a distance corresponding to a width of the first panel portion 8*a* and the width of the second panel portion 8*b* formed therebetween. Each of said formers consists of a horizontal negative form roller 21*a* and a horizontal positive form roller 21*b* arranged above and below so as to face to each other, as shown in FIGS. 13 and 14.

Figure 13:
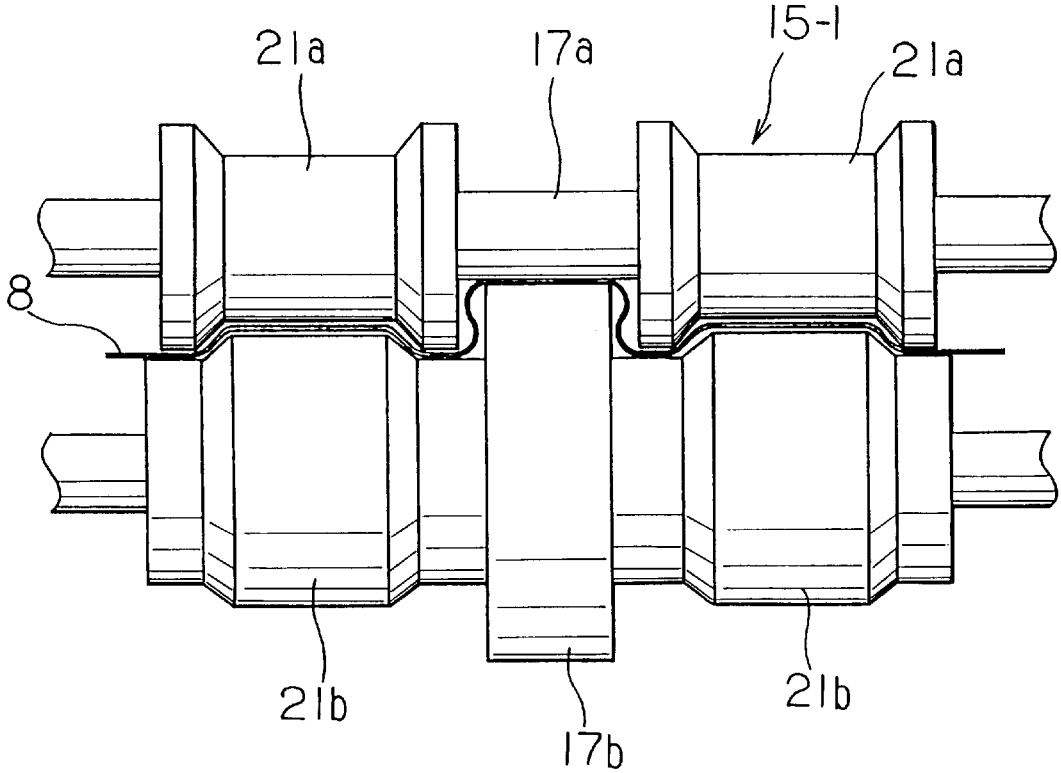
FIG. 13 is a front view of a first forming element in a third forming means of the panel forming apparatus according to the present invention.
Figure 14:
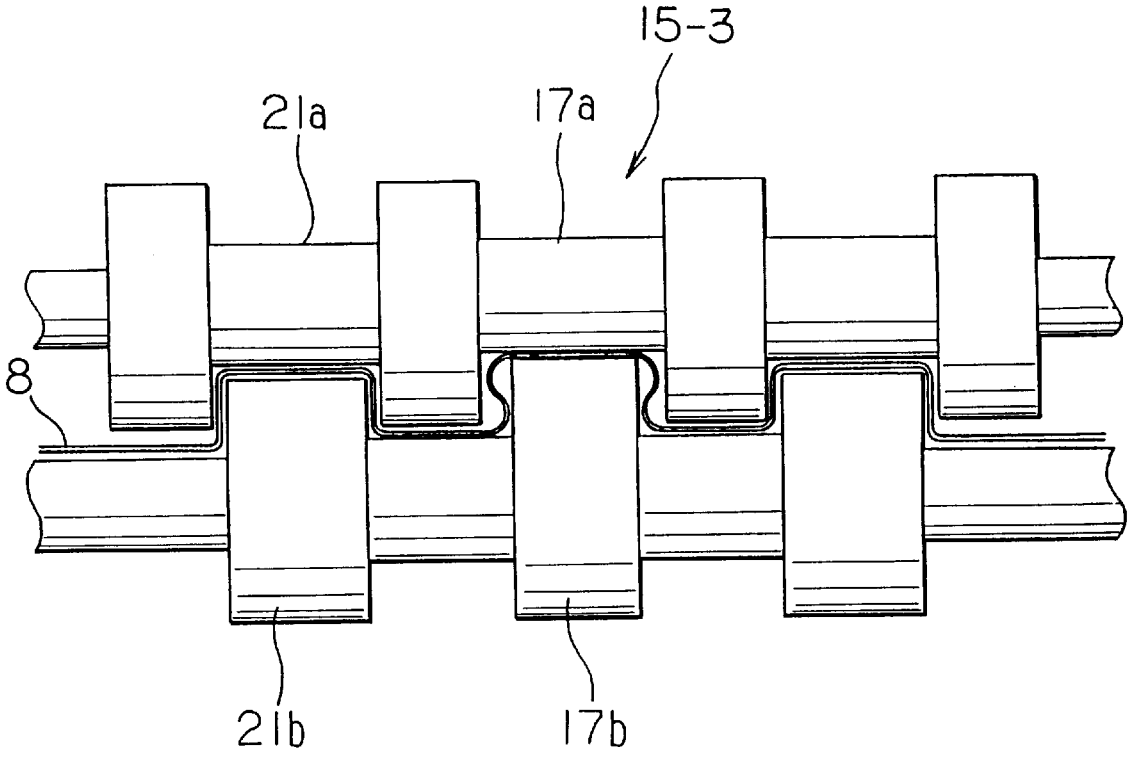
FIG. 14 is a front view of a third forming element in the third forming means of the panel forming apparatus according to the present invention.

The figures of the negative and positive form rollers 21*a* and 21*b* of said first forming element 15-1 at the upstream side of said forward direction of the sheet panel 8 are so determined that a shallower projection can be formed on the sheet panel 8, as shown in FIG. 13, and the figures of the negative and positive form rollers 21*a* and 21*b* of the third forming elements 15-3 at the downstream side of said forward direction of the sheet panel 8 are so determined that a deeper projection can be formed on the sheet panel 8, as shown in FIG. 14.

The figures of the negative and positive form rollers 21*a* and 21*b* of said second forming element 15-2 at the intermediate position between said first and third form elements 15-1 and 15-3 are so determined that a projection of an intermediate height can be formed on the sheet panel 8.

As shown in FIG. 9, a distance between the centers of said formers of the first forming element 15-1 is larger, and a distance between the centers of said formers of the third forming element 15-3 is shorter.

Said fourth forming means 16 consists of first to third forming elements 16-1 to 16-3 arranged in order in the forward direction of said sheet panel 8. Each of said fourth forming elements 16-1 to 16-3 comprises two gourd-shaped vertical inside rollers 22*a* and 22*a* facing the inside side faces of each of said side projections, respectively, and two gourd-shaped vertical outside rollers 22*b* and 22*b* facing the outside side faces of each of said side projections, respectively, as shown in FIG. 15.

A gap 23 formed between corresponding gourd-shaped vertical inside and outside rollers 22*a* and 22*b* at the upstream side of said forward direction of the sheet panel 8 is larger, and a gap 23 formed between corresponding gourd-shaped vertical inside and outside rollers 22*a* and 22*b* at the downstream side of the forward direction of the sheet panel 8 is smaller.

Said S-shaped curve face 13 corresponds in configuration to the convex portion of the first panel portion 8*a* and the concave portion of the second panel portion 8*b* of the sheet panel 8.

Figure 15:
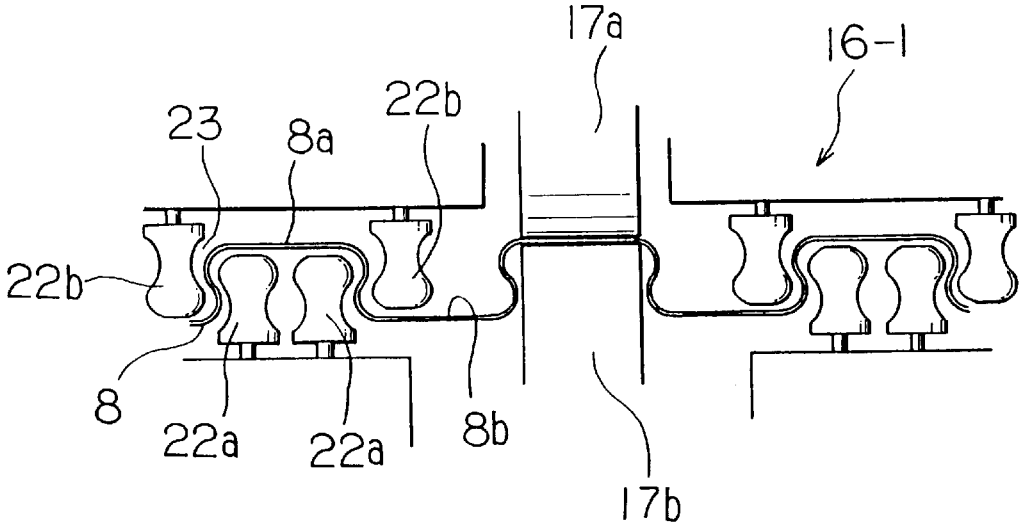
FIG. 15 is a front view of a first forming element in a fourth forming means of the panel forming apparatus according to the present invention.

Said roller means 17 consists of upper and lower rollers 17*a* and 17*b* arranged so as to contact to the upper and lower surfaces of said projection of the sheet panel 8, as shown in FIG. 15.

It is preferable to provide the same roller means 17 at the center portion of each of said first to third elements 15-1 to 15-3 of the third forming means 15, as shown in FIGS. 13 and 14.

According to the panel forming apparatus of the present invention, the center projection of substantially rectangular form is formed on the sheet panel 8 by the first forming means 12, the S-shaped curve faces 13 are formed on the both sides of said center projection by the second forming means 14, the side projections of substantially rectangular form are formed at both sides of said center projection by the third forming means 15, and the S-shaped curve faces 13 are formed on the both sides of each of said side projection by the forth forming means 16.

The sheet panel 8 is forwarded by the rotations of the negative and positive form rollers and the roller means 17.

In the above embodiments, three projections and two recesses are formed on the sheet panel 8. However, more than three of the projections and more than two of recesses can be formed by adding further forming means.

As stated above, the sheet panel 8 comprising the first panel portions 8*a* facing downward and the second panel portions 8*b* facing upward can be formed easily by the panel forming apparatus of the present invention.

It is obvious that the invention is not restricted to the embodiments described above by way of example and shown in the drawings but that it may be modified in many ways without departing from the scope and spirit of the invention.

What is claimed is:

1. A panel forming apparatus comprising:

a first forming means for forming a center projection at a central portion of a sheet panel;

a second forming means for forming a first set of S-shaped curve faces on a first side and a second side of the center projection of the sheet panel;

a third forming means for forming a plurality of side projections at the first side and the second side of the center projection of the sheet panel;

a fourth forming means for forming a second set of S-shaped curve faces on a first side and a second side of the plurality of side projections of the sheet panel;

wherein the first, the second, the third and the fourth forming means are arranged in order in a forward direction of the sheet panel;

wherein the first forming means and the third forming means each include a horizontal negative form roller arranged on a first side of the sheet panel, and an opposed horizontal positive form roller arranged on a second side of the sheet panel; and wherein the second forming means and the fourth forming means each include a pair of gourd-shaped vertical inside rollers facing a pair of inside faces of each of the projections, and a pair of gourd-shaped vertical outside rollers facing a pair of outside faces of each of the projections.

2. A panel forming apparatus comprising:

a first forming means for forming a center projection at a central portion of a sheet panel;

a second forming means for forming a first set of S-shaped curve faces on a first side and a second side of the center projection of the sheet panel;

a third forming means for forming a plurality of side projections at the first side and the second side of the center projection of the sheet panel;

a fourth forming means for forming a second set of S-shaped curve faces on a first side and a second side of the plurality of side projections of the sheet panel;

wherein the first, the second, the third and the fourth forming means are arranged in order in a forward direction of the sheet panel;

wherein the first forming means and the third forming means each include a horizontal negative form roller arranged on a first side of the sheet panel, and an opposed horizontal positive form roller arranged on a second side of the sheet panel, the negative form roller and the positive form roller at an upstream side of the forward direction of the sheet panel forming a shallow projection, and the negative form roller and the positive form roller at a downstream side of the forward direction of the sheet panel forming a deep projection; and wherein the second forming means and the fourth forming means each include a pair of gourd-shaped vertical inside rollers facing a pair of inside faces of each of the projections, and a pair of gourd-shaped vertical outside rollers facing a pair of outside faces of each of the projections.

3. A panel forming apparatus comprising:

a first forming means for forming a center projection at a central portion of a sheet panel;

a second forming means for forming a first set of S-shaped curve faces on a first side and a second side of the center projection of the sheet panel;

a third forming means for forming a plurality of side projections at the first side and the second side of the center projection of the sheet panel;

a fourth forming means for forming a second set of S-shaped curve faces on a first side and a second side of the plurality of side projections of the sheet panel;

wherein the first, the second, the third and the fourth forming means are arranged in order in a forward direction of the sheet panel;

wherein the first forming means and the third forming means each include a horizontal negative form roller arranged on a first side of the sheet panel, and an opposed horizontal positive form roller arranged on a second side of the sheet panel, the negative form roller and the positive form roller at an upstream side of the forward direction of the sheet panel forming a shallow projection, and the negative form roller and the positive form roller at a downstream side of the forward direction of the sheet panel forming a deep projection;

wherein the second forming means and the fourth forming means each include a pair of gourd-shaped vertical inside rollers facing a pair of inside faces of each of the projections, and a pair of gourd-shaped vertical outside rollers facing a pair of outside faces of each of the projections; and wherein a first gap is formed between corresponding gourd-shaped vertical inside and outside rollers at the downstream side of the forward direction of the sheet panel, and a second gap is formed between the corresponding gourd-shaped vertical inside and outside rollers at the upstream side of the forward direction of the sheet panel.

4. The panel forming apparatus according to claim 3, wherein the first gap is smaller than the second gap.

* * * * *